US010907926B1

(12) United States Patent
Alba

(10) Patent No.: US 10,907,926 B1
(45) Date of Patent: Feb. 2, 2021

(54) ARCHERY BOW STABILIZER WITH SADDLE FOREARM SUPPORT

(71) Applicant: Daniel Lee Alba, Blanco, TX (US)

(72) Inventor: Daniel Lee Alba, Blanco, TX (US)

( * ) Notice: Subject to any disclaimer, the term of this patent is extended or adjusted under 35 U.S.C. 154(b) by 0 days.

(21) Appl. No.: 16/593,193

(22) Filed: Nov. 27, 2019

(51) Int. Cl.
*F41B 5/20* (2006.01)
*F41B 5/14* (2006.01)

(52) U.S. Cl.
CPC ..... *F41B 5/1426* (2013.01); *F41B 5/1453* (2013.01)

(58) Field of Classification Search
CPC ..... F41B 5/1426; F41B 5/1453
See application file for complete search history.

(56) References Cited

U.S. PATENT DOCUMENTS 3,256,872 A * 6/1966 Koser ..... F41B 5/14 124/23.1
5,205,272 A * 4/1993 Boyer ..... F41B 5/14 124/88
5,464,002 A * 11/1995 Lavoie ..... F41B 5/14 124/23.1
6,173,707 B1 * 1/2001 Howell ..... F41B 5/14 124/88
6,957,648 B1 * 10/2005 Adcock ..... F41B 5/1426 124/86
7,748,369 B2 * 7/2010 Chee ..... F41B 3/02 124/20.1
9,372,046 B2 * 6/2016 Albanese ..... F41B 5/1426
2012/0174904 A1 * 7/2012 Greenhoe ..... F41B 5/1426 124/89

* cited by examiner

*Primary Examiner* — John A Ricci

(57) ABSTRACT

The present invention relates to improvements to a traditional archery stabilizer with an added forearm saddle that supports the weight of the bow while carrying it. This invention also allows an archer to prop the bow safely (riser face down) keeping the main functional components of the bow from touching the ground. Further, by resting a person's forearm in the saddle aids in arm, wrist, and hand fatigue while carrying a bow when walking or hiking.

1 Claim, 6 Drawing Sheets

3D VIEW

First end view

Side View

Top View

Tripod Feature

Gripping/saddle
Placement on forearm

ARCHERY BOW STABILIZER WITH SADDLE FOREARM SUPPORT

TECHNICAL FIELD

The present invention relates to improvements to a traditional archery stabilizer with an added forearm saddle that supports the weight of the bow while carrying it.

BACKGROUND ART

There are many known straight-line front mounted archery stabilizers on the market. However, there are no known front mounted archery stabilizers that have the added luxury of a saddle shaped forearm/bow rest.

SUMMARY OF THE INVENTION

The Mule archery stabilizer is a front mounted archery stabilizer that provides forearm support while walking/hiking and holding a bow by the riser/grip. The Mule archery stabilizer also allows an archer to rest the bow (riser face down) allowing the cams, strings, and cables to be free from debris by contacting the ground.

According to the present invention, the Mule archery stabilizer comprises: a 6" aluminum, carbon fiber, or titanium tubular body (Can also be fabricated in 4", 8", 10", and 12"); a 5/16x24 riser mount bolt/nut adjustment; and a saddle shaped forearm support comprised of the same lightweight material.

According to the present invention, the Mule archery stabilizer can be powder coated, hydro dipped, painted, dipped in rubberized coating, or wrapped in para cord to suit the consumer.

Further, according to the present invention, the Mule archery stabilizer provides balance while shooting a bow, and drastically absorbs shock while releasing an arrow from a bow.

DETAILED DESCRIPTION OF THE INVENTION

The Mule Archery Stabilizer includes a tubular rectangular body 1 which extends along a longitudinal axis. At a first end of the body is a bolt 3, which may be a 5/16x24 stainless steel bolt, with an associated adjustment nut 4, which may be a 5/16x24 stainless steel nut. At a second end of the body is a saddle-shaped forearm/tripod rest 2. The saddle includes two arms which extend in divergent directions away from the longitudinal axis, and in a plane substantially perpendicular to the longitudinal axis.

Figure 1:
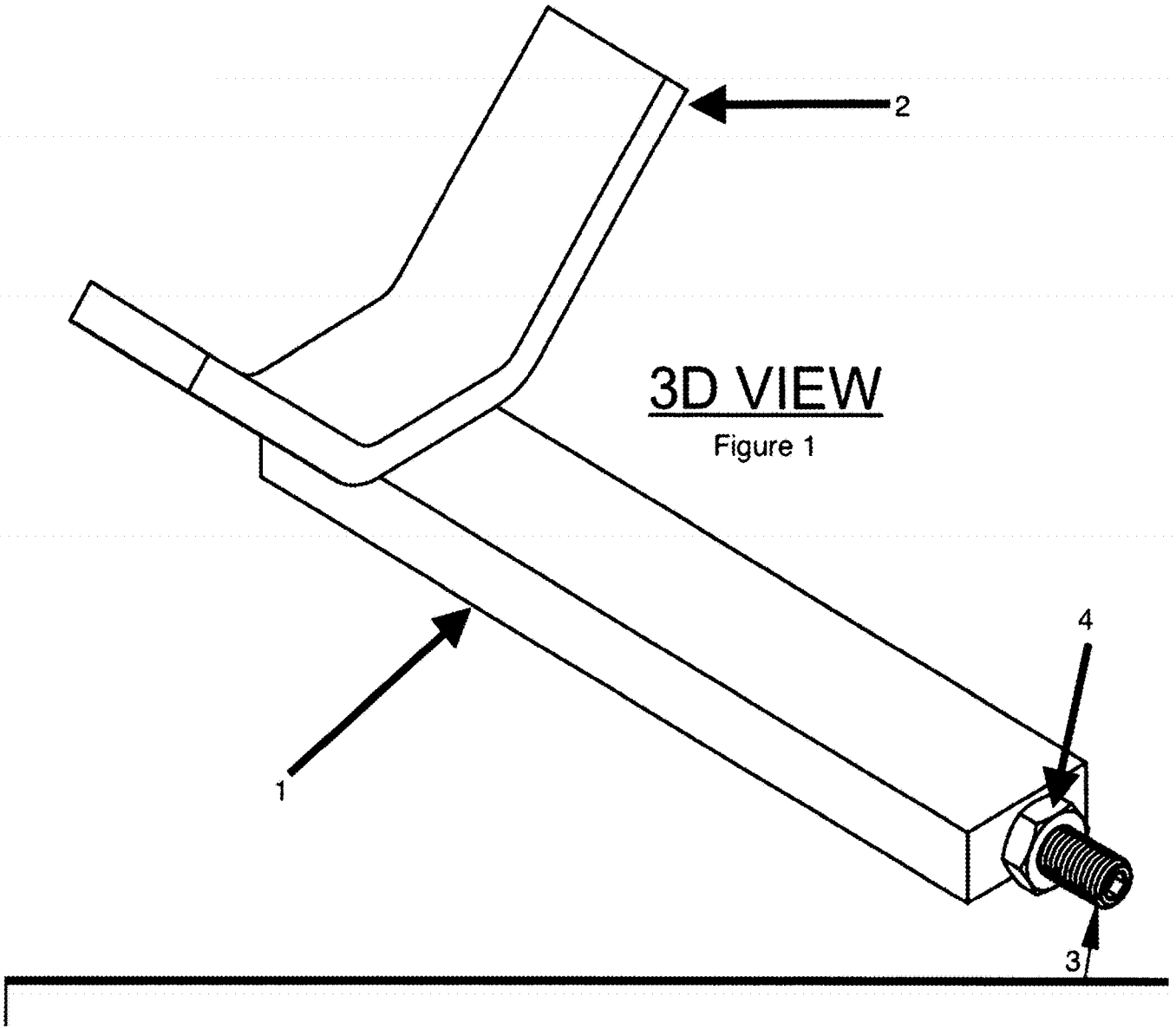
FIG. 1 is a perspective view of the tubular/rectangular body with attached saddle shaped forearm rest mounted to the second end of stabilizer.
Figure 2:
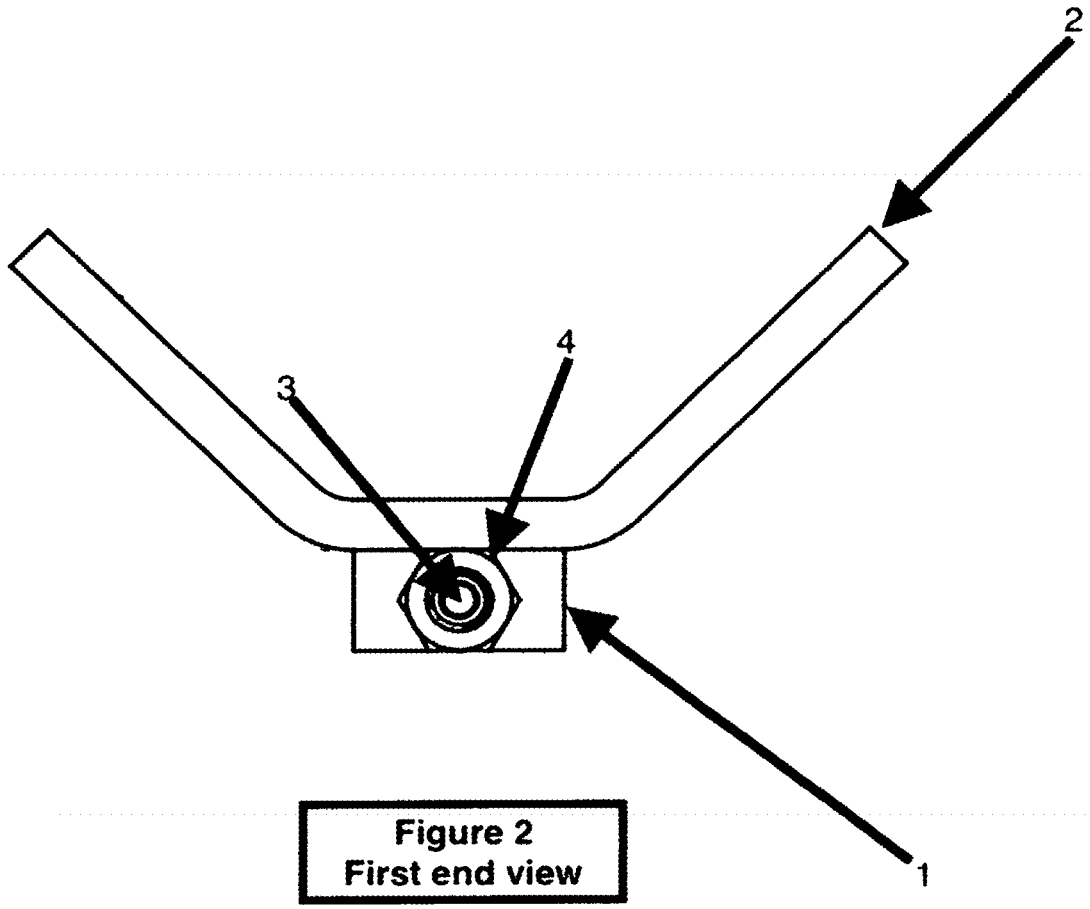
FIG. 2 is the view of the stabilizer from the first end of the body that shows the forearm/tripod rest that includes two arms which extend in divergent directions away from the longitudinal axis.
Figure 3:
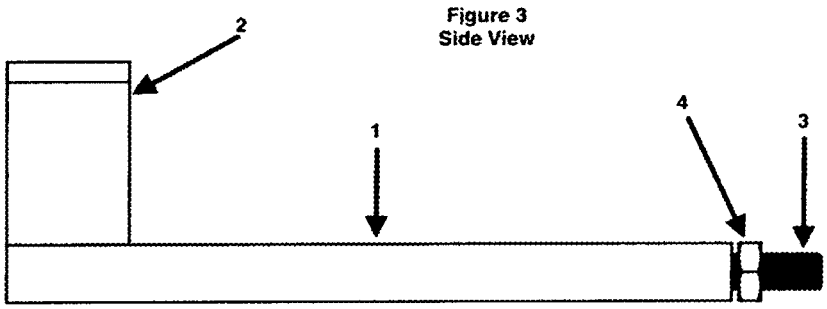
FIG. 3 is the side view of tubular/rectangular body with attached saddle shaped forearm rest mounted to the second end of stabilizer.
Figure 4:
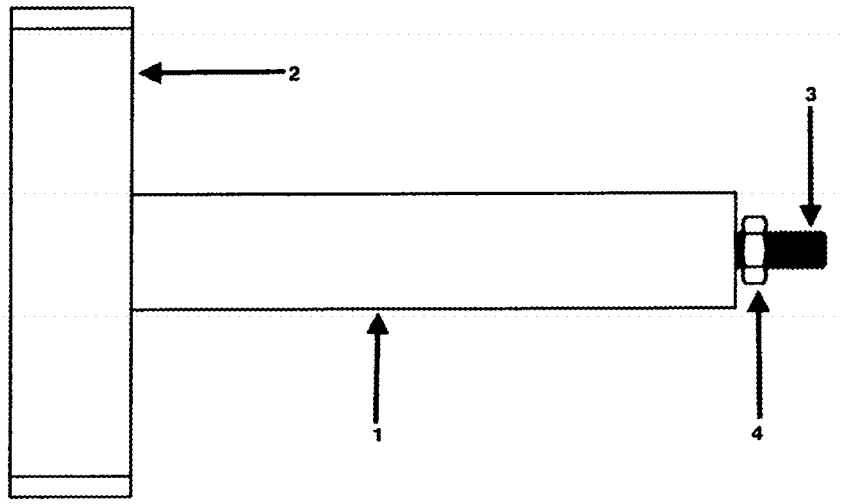
FIG. 4 is the top view of the tubular/rectangular body with attached saddle shaped forearm rest mounted to the second end of stabilizer.
Figure 5:
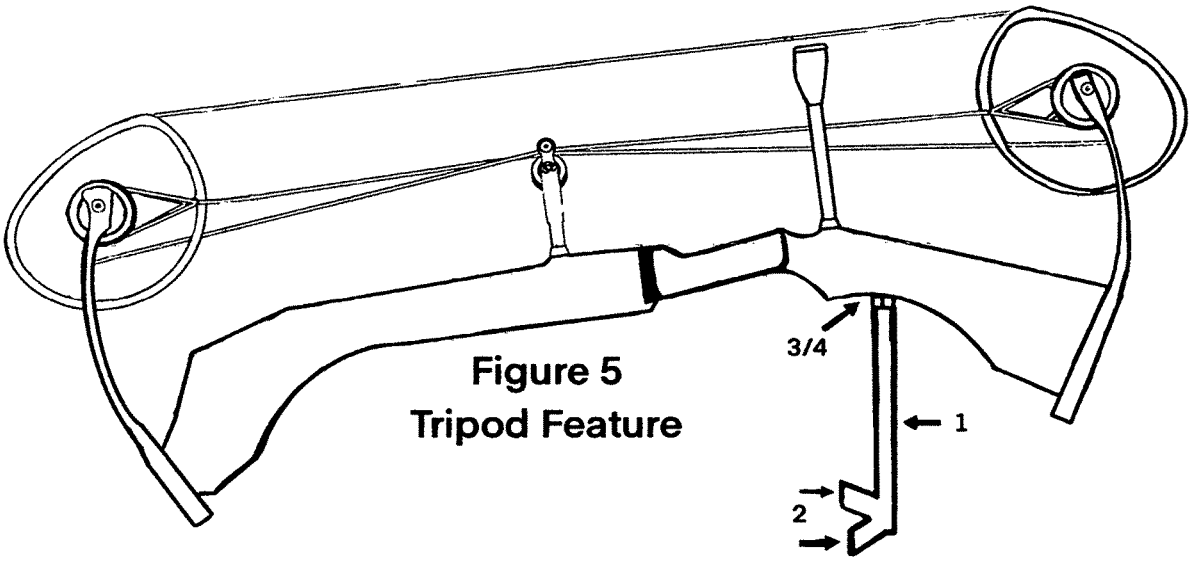
FIG. 5 is the view of the archery bow rested on a ground using the stabilizer saddle at the second end reference "tripod".
Figure 6:
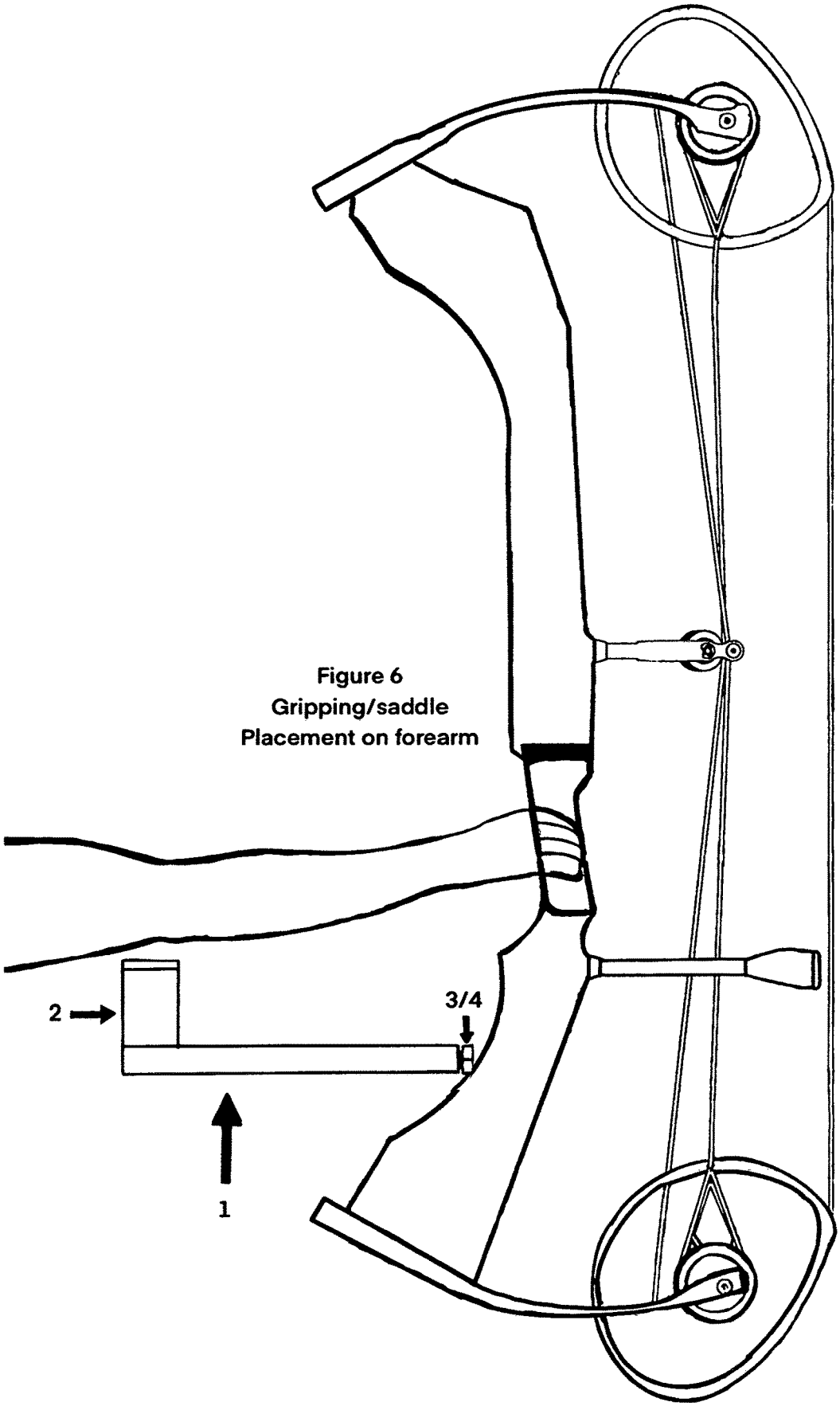
FIG. 6 is a view of the saddle shaped forearm rest securely resting in an archer's forearm when an archer grips the riser.

The stabilizer is intended to be attached to the riser of an archery bow, extending forward in a shooting direction, using the bolt attachment. As shown in FIG. 5, the ends of the arms are arranged to serve as two points of a tripod support, so the bow can be rested on any surface, with an end of the riser serving as a third point of support. As shown in FIG. 6, the arms also serve as an arm support as a user grips and carries the bow. In addition, the saddle mounted to the tubular body adds weight to the stabilizer, forward of center, for added stabilization while shooting the archery bow.

The invention claimed is:

1. An archery stabilizer comprising:

a rectangular/tubular body for attachment to an archery bow, extending along a longitudinal axis, from a front of a bow riser; said stabilizer having a first end and a second end;

a threaded attachment at the first end, adapted for attachment to the riser of the archery bow;

a saddle mounted to the tubular body, substantially at the second end, the saddle includes two arms which extend in divergent directions away from the longitudinal axis, and in a plane substantially perpendicular to the longitudinal axis;

the arms of a length and shape which are effective to:

a) serve as an arm support as a user grips and carries the bow; and b) serve as two points of a tripod support, when the stabilizer is attached to extend in a longitudinally forward direction from the bow, and the bow is rested on any surface, with an end of the riser serving as a third point of support, and c) the saddle mounted to the tubular body serves to counterweight the stabilizer, forward of center, for added stabilization while shooting the archery bow.

* * * * *